US005599164A

United States Patent [19]

Murray

[11] Patent Number: 5,599,164

[45] Date of Patent: Feb. 4, 1997

[54] CENTRIFUGAL PROCESS PUMP WITH BOOSTER IMPELLER

[76] Inventor: William E. Murray, 7002 Dew Bridge Ct., Sugarland, Tex. 77479

[21] Appl. No.: 415,444

[22] Filed: Apr. 3, 1995

[51] Int. Cl.[6] ..... F04D 13/14

[52] U.S. Cl. ..... 415/144; 415/169.1; 415/198.1; 415/58.1

[58] Field of Search ..... 415/58.1, 59.1, 415/143, 144, 169.1, 198.1

[56] References Cited

U.S. PATENT DOCUMENTS

| | | | |
|---|---|---|---|
| 825,964 | 1/1906 | Godfrey . | |
| 1,049,894 | 1/1913 | Merrill | 415/144 |
| 1,076,462 | 10/1913 | Steinbecker . | |
| 1,737,870 | 12/1929 | Telfer . | |
| 1,988,875 | 1/1935 | Saborio . | |
| 2,280,626 | 4/1942 | Carpenter . | |
| 2,553,066 | 5/1951 | Southern | 415/144 |
| 2,828,066 | 3/1958 | Wellauer . | |
| 2,833,525 | 5/1958 | Pennington | 415/169.1 |
| 2,918,975 | 12/1959 | Conery et al. . | |
| 3,004,494 | 10/1961 | Corbett . | |
| 3,063,673 | 11/1962 | Johnson . | |
| 3,107,625 | 10/1963 | Amberg . | |
| 3,115,097 | 12/1963 | Zagar et al. . | |
| 3,118,386 | 1/1964 | Carswell | 415/144 |
| 3,213,798 | 10/1965 | Carswell | 415/58.1 |
| 3,299,815 | 1/1967 | Thaw . | |
| 3,542,496 | 11/1970 | Bergeson et al. | 415/143 |
| 3,647,314 | 3/1972 | Laessig . | |
| 3,656,861 | 4/1972 | Zagar . | |
| 3,707,336 | 12/1972 | Theis, Jr. et al. . | |
| 3,708,241 | 1/1973 | Theis, Jr. et al. . | |
| 4,029,431 | 6/1977 | Bachl . | |
| 4,067,665 | 1/1978 | Schwartzman . | |
| 4,195,965 | 4/1980 | Masnik . | |
| 4,208,282 | 6/1980 | Eberhardt . | |
| 4,293,278 | 10/1981 | Bachl . | |
| 4,734,019 | 3/1988 | Eberhardt | 415/169.1 |
| 4,779,575 | 10/1988 | Perkins . | |

FOREIGN PATENT DOCUMENTS

| | | | |
|---|---|---|---|
| 366378 | 12/1938 | Italy | 415/144 |
| 2135022 | 8/1984 | United Kingdom | 415/144 |

OTHER PUBLICATIONS

Byron Jackson Pump Division—Borg Warner Corporation, 4 Stage–Type HDB Byron Jackson Boiler Feed Pump Drawing, Jun. 1978, 1 page.

Byron Jackson Pump Division—Borg Warner Corporation, High Pressure–Double Case–Type HDB & HSB Feed Pumps Booster Stage Take–Off (Optional) Drawing, Jun. 1978, 1 page.

BW/IP International, Inc., Two Stage Process Pumps—Type GSJA Drawing, Mar. 1983, 1 page.

BW/IP International, Inc., Single Stage Process Pumps—Type SC7, Sep. 1991, 1 page.

BW/IP, Byron Jackson Submersibles Brochure, Sep. 1989, 6 pages.

Tyler G. Hicks, P. E. and T. W. Edwards, P. E., Pump Application Engineering—Book, 1971, pp. 305–306.

(List continued on next page.)

*Primary Examiner*—James Larson

[57] ABSTRACT

A centrifugal pump assembly and method of using same including a vertical or horizontal overhung housing assembly having a primary inlet, a primary discharge, a secondary inlet and a secondary discharge. A shaft is in spaced relationship within the overhung housing assembly. A single primary impeller is mounted on the shaft for receiving fluid from the primary inlet and discharging fluid through the primary discharge. A booster impeller is mounted on the shaft and juxtaposed the main impeller for receiving fluid from the secondary inlet and discharging fluid through the secondary discharge. All fluid introduced to the secondary inlet originates from the primary discharge or may be diverted from the fluid flow upstream of the centrifugal pump assembly or the primary impeller. The fluid in the secondary inlet flows through the booster impeller and discharges through the secondary discharge. The secondary discharge is separate from the primary discharge.

2 Claims, 6 Drawing Sheets

OTHER PUBLICATIONS

Val S. Lobanoff and Robert R. Ross, Centrifugal Pumps—Design and Application—Book, 1985, pp. 197–199, 202, 204, 207 and 216.

Goulds Pumps, Inc., GPM Goulds Pump Manual (Fifth Edition), 1988, pp. 6A–6B.

BW/IP International, Inc., Two Stage Process Pump—Type GSJH, Mar. 1983, 1 page.

BW/IP International, Inc., Preliminary Selection Range Chart Double Case Type HDB Feed Pump and Single Stage Process Pumps Range Chart Drawings, Jun. 1978, 2 pages.

CENTRIFUGAL PROCESS PUMP WITH BOOSTER IMPELLER

SPECIFICATION

1. Field of the Invention

The present invention relates to centrifugal process pumps and more particularly single-stage, overhung-type centrifugal process pumps having a discharge booster impeller.

2. Background of the Invention

Centrifugal process pumps are widely used in the petroleum industry, particularly in refining and petrochemical plants. The requirements for these pumps include operating temperatures varying from about ambient to about 800° F., with pressures up to approximately 600 pounds per square inch (psi) and flow rates ranging from approximately 10 gallons per minute (gpm) to approximately 8,000 gpm. Pump companies have developed many different types of pumps to fulfill the demands of the petroleum industry. The American Petroleum Institute (API) has issued pump specification API Standard 610 (API 610) which outlines basic mechanical, hydraulic and testing requirements for the various types of pumps to satisfy the demands of the petroleum industry. The API specification is very stringent with regards to centrifugal process pumps for use in the petroleum industry due to the obvious safety precautions.

Centrifugal pumps are also widely used in industries other than the petroleum industry. Pump specifications other than API are usually used in other industries. One such specification is the specification of American National Standards Institute (ANSI).

The present invention involves the use of a booster impeller with a centrifugal pump. The term "booster" in pumping systems is used in different ways. A "booster pump" is sometimes used to refer to a separate pump on the suction/inlet side of a primary pump to increase the net positive suction head (NPSH) to the primary pump. The NPSH is an analysis of energy conditions on the suction side of a pump to determine if the liquid will vaporize at the lowest pressure point in the pump. One such booster pump system is disclosed in U.S. Pat. No. 3,299,815 to Thaw. A "suction booster device", such as an inducer, incorporated as part of the primary pump to improve its NPSH is also called a booster. Examples of this are disclosed in U.S. Pat. No. 3,004,494 to Corbett and U.S. Pat. No. 4,067,665 to Schwartzman.

A secondary pump (or another impeller) downstream of and in series with the primary pump (or primary impeller) to increase discharge pressure is also called a booster. An example of this is disclosed in U.S. Pat. No. 4,209,282 to Eberhardt. A pump may be classified as a single-stage (one impeller pumping all the fluid) or as a multi-stage (two or more impellers all pumping the same flow of fluid).

Furthermore, pump design configurations are classified as "overhung" and "between bearing." "Overhung" pumps are characterized by impellers mounted on a shaft cantilevered from a bearing bracket or mounted on an extended motor shaft where the motor bearings also serve as pump bearings. Overhung pumps may be single or two-stage, may use single or double-suction impellers, and may be mounted with shafts horizontal or vertical. A single-suction impeller has an inlet on one side and a double-suction impeller has inlets on both sides of the impeller. Bearings are generally anti-friction (ball) type. Due to the cantilevered shaft, overhung pumps are typically small (5 to 800 horsepower), discharge pressure of 30 to 600 psi, and generally operate at 1800 or 3600 rpm. Typically, the maximum impeller diameter for an overhung pump operating at 3600 rpm is approximately 13 to 15 inches and for an overhung pump operating at 1800 rpm is approximately 23 inches.

"Between bearing" pumps are characterized by impellers mounted on a shaft supported by bearings on both sides of the impellers. They may be single-stage (usually with double-suction impellers) or multi-stage, with bearings either anti-friction (for smaller sizes) or sleeve-type for larger sizes and/or high speed (greater than 3600 rpm) applications. This type of pump is typically used where flows and/or pressures exceed accepted limits for the less expensive overhung type.

Where suitable, overhung pumps are typically more desirable than between bearing pumps because they are less expensive and require only one mechanical seal versus two mechanical seals for a between bearing pump. In a refinery application required to comply with API 610, the between bearing pump may cost approximately 1.5 to 2 times more than the comparable overhung pump. It is understood that API 610 is more stringent than the more general purpose pump specifications of ANSI. As a result of the more stringent specifications, an API 610 pump may cost on the order of approximately twice that of the same size ANSI pump. One example of the more stringent requirements of API 610 over ANSI is that API does not permit a multistage overhung pump whereas ANSI does. A multistage pump is a pump using two or more impellers operating in series with each impeller pumping the same flow. If a two-stage pump (multi-stage pump having two impellers each pumping the same flow) is required in an application having to comply with API 610, the more expensive, between bearing pump must be used instead of the overhung pump.

A primary concern with overhung pumps is keeping the pump shaft deflection at the impeller to a minimum. Pump shaft deflection is affected by various factors including the length and diameter of the cantilevered shaft portion and the diameter of the pump impeller mounted on the cantilevered shaft portion.

Some pumping systems require pumping a fluid from a single source to two or more different destinations having different head-capacity requirements. This pumping system requires compromises when one head-capacity requirement is a high pressure (head) at low flow (capacity) and the second head-capacity requirement is a lower pressure (head) at higher flow (capacity).

Important factors in the overall pumping system design are the economics of operating the pumping system and the projected maintenance costs. These factors are interrelated with the efficiency of the pumping system. Pump efficiency is defined as the ratio of the hydraulic horsepower to the brake horsepower. Hydraulic horsepower (whp) or pump output is the liquid horsepower delivered by the pump. Brake horsepower (bhp) or pump input is the actual horsepower delivered to the pump shaft. The brake horsepower is always greater than the hydraulic horsepower of a pump due to the mechanical and hydraulic losses incurred in the pump.

For exemplary purposes, assume the two destinations are "A" and "B" where destination "A" requires a high head at a low flow and destination "B" requires a lower head at a higher flow.

One solution may be to have a separate centrifugal process pump for each destination "A" and "B." This may not be the optimum solution due to the increased maintenance and costs required for two process pumps and the motors to operate these two pumps.

Another solution may be to use one oversized centrifugal process pump to pump fluids from a single source to destinations "A" and "B" with a throttling valve. In such a situation, a typical pump selected must have the pump head-capacity characteristic curve to envelop the requirements of destinations "A" and "B." The pump head-capacity characteristic curve cannot envelop the high head/low flow requirement of destination "A" without producing excess head at the low head/high flow requirement of destination "B." This results in an inefficient pumping system due to the divergent head-capacity requirements of the dual destinations. When the pump's head-capacity curve must envelop such different rating points (i.e., low head at high flow and high head at low flow), a pump is selected which will be larger and more costly than a pump having to envelop one set of head-capacity requirements. A larger pump requires more horsepower delivered to the pump shaft which in turn requires a larger horsepower motor which is more expensive to purchase and operate. The required throttling valve also results in additional cost and maintenance. Such a solution is inefficient and costly.

Another solution may be to use a primary pump and a separate booster pump driven by a common motor. U.S. Pat. No. 4,209,282 to Eberhardt discloses a pump assembly having a primary pump and a booster pump driven from a common rotating shaft. The primary pump delivers low head at high flow fluid and the booster pump delivers high head at low flow fluid. The two-stage, overhung, high head, low flow booster pump takes suction from a single-stage, double suction impeller, overhung primary pump. The impellers of the booster pump and the impeller of the primary pump are in separate pump cases and mounted on a common shaft with geared power input to the shaft between the pump cases. The Eberhardt booster pump incorporates a bypass from the booster pump discharge to the primary pump suction (to protect the booster pump from damage if dead-headed). The Eberhardt booster pump is a single casing type with a maximum discharge pressure of approximately 400 psi from the booster pump. The Eberhardt pump assembly is two pumps powered from a single prime mover. Thus, from a maintenance standpoint, the Eberhardt pump assembly may require additional maintenance over a single pump servicing both destinations.

It is known in the art to include a booster impeller in series with the last stage primary impeller of a double case, multistage, between bearing pump to produce a separate discharge of low flow at higher than primary discharge pressure. These double case, multistage, between bearing pumps are very large (3,000 to 50,000 horsepower), high pressure (2,500 to 4,500 psi), and generally operate between 4,500 to 6,000 rpm. These pumps are typically used for main boiler feed service in electric generating plants. The incorporation of a booster impeller in a double case pump requires more horsepower. The booster impeller is incorporated not as an energy saving feature but rather as a means of avoiding the use of an expensive auxiliary pump. Unlike the conventional overhung process pump, this multistage, between bearing pump design lends itself to the incorporation of an auxiliary impeller.

It is desirable to have a single pump assembly which can satisfy the head-capacity requirements of two different flow streams energy efficiently and cost efficiently. It is also desirable to have a single pump assembly which produces its normal rated head-capacity flow stream and additionally produces a separate higher-head, low-capacity flow stream. It is also desirable that the pump assembly be of the lesser expensive overhung-type pump and that required maintenance be kept to a minimum.

SUMMARY OF THE INVENTION

The centrifugal process pump with booster impeller and method enables the pump to produce its normal rated head-capacity flow stream and additionally, produce a separate higher-head, low-capacity flow stream. The centrifugal process pump with booster impeller is effectively two pumps in one, and saves input energy and control valve losses in cases where a single pump is used to satisfy the head-capacity requirements of two different flow streams.

The centrifugal pump assembly with booster impeller is an overhung pump with a single-stage primary impeller and a single-stage booster impeller taking suction from the discharge of the primary impeller. The primary impeller produces a low head at high capacity flow stream and the booster impeller produces a higher head at lower capacity flow stream. The primary and booster impellers are substantially adjacently mounted on a cantilevered portion of a pump shaft.

The centrifugal pump assembly with booster impeller is effectively two pumps in one casing with the pump assembly having a common suction and two separate discharges. It is not classified as a two-stage pump because the primary and booster impellers do not pump the same flow (i.e., all flow from primary impeller does not flow through booster impeller). The booster impeller is incorporated into the same pump case assembly as the primary impeller and increases the shaft cantilever by approximately 20% as compared with approximately 100% for a second stage impeller of a conventional two-stage overhung pump.

The centrifugal pump assembly with booster impeller results in energy savings by utilizing a more efficient hydraulic configuration which thereby allows use of a lower horsepower prime mover (motor).

BRIEF DESCRIPTION OF THE DRAWINGS

The objects, advantages and features of the invention will become more apparent by reference to the drawings which are appended hereto and wherein like numerals indicate like parts and wherein illustrated embodiments of the invention are shown, in which.

DETAILED DESCRIPTION OF PREFERRED EMBODIMENT

Two detailed illustrative embodiments of the invention are disclosed herein exemplifying the invention which may, of course be embodied in other forms, some of which will vary from the illustrative embodiments as disclosed. It is to be understood that the specific structural details disclosed herein are representative and they provide a basis for the claims herein.

Figure 1:
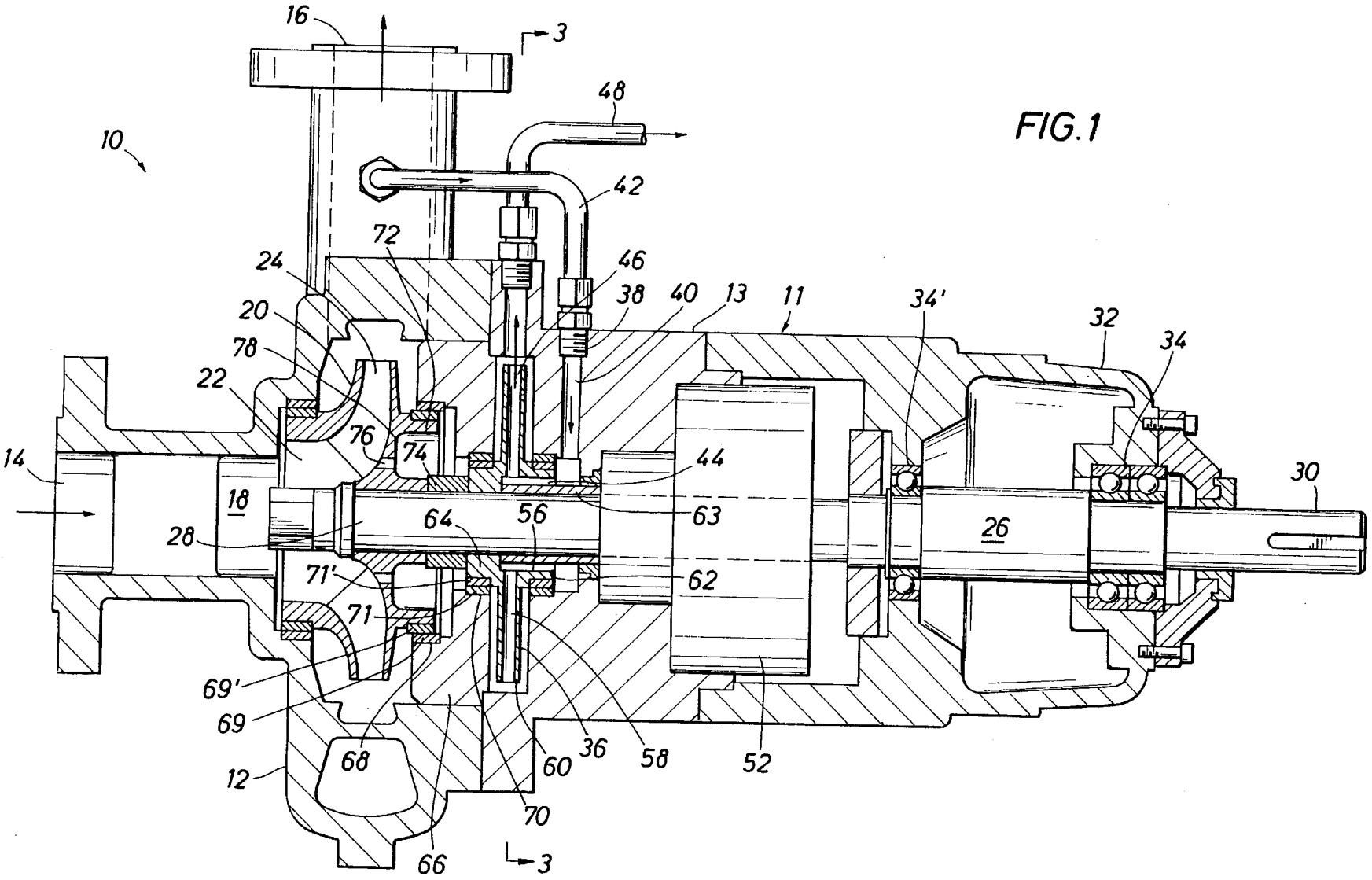
FIG. 1 is a sectional view in elevation of the centrifugal pump assembly according to a first embodiment of the present invention, the centrifugal pump assembly shown as an overhung, horizontal, single-stage, end suction pump with a booster impeller.

FIG. 1 discloses the centrifugal pump assembly according to a first embodiment of the present invention in which the centrifugal pump assembly is shown as an overhung, horizontal, single-stage, end suction, top discharge pump with a booster impeller. Although not shown, it is within the scope of the present invention that the centrifugal pump assembly disclosed in FIG. 1 could alternatively be a top suction as opposed to the end suction type as shown.

Figure 2:
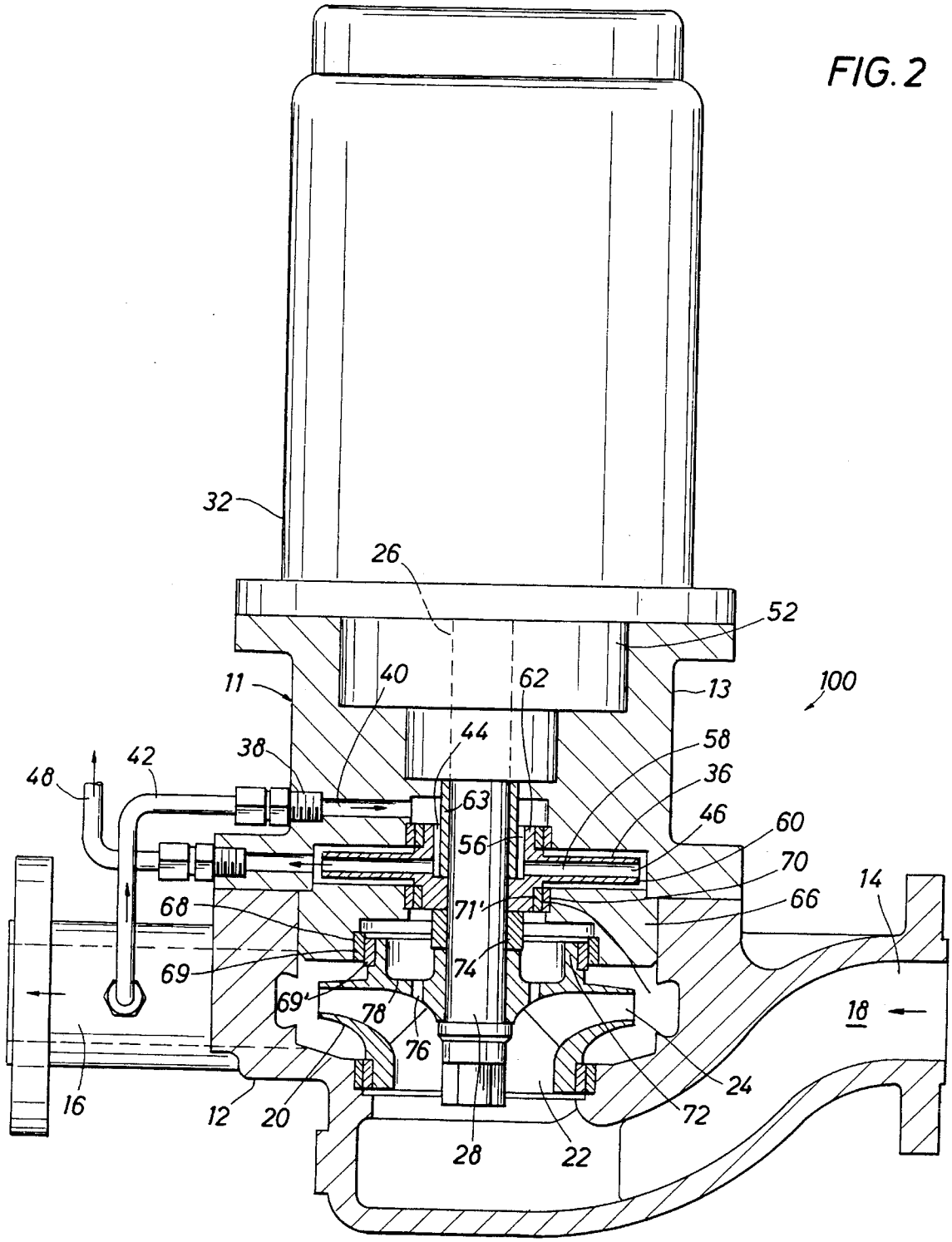
FIG. 2 is a sectional view in elevation of the centrifugal pump assembly according to a second embodiment of the present invention, the centrifugal pump assembly shown as an overhung, in-line, single-stage pump with a booster impeller.

FIG. 2 discloses the centrifugal pump assembly according to a second embodiment of the present invention in which the centrifugal pump assembly is shown as an overhung, vertical in-line, single-stage pump with a booster impeller.

The centrifugal pump assembly according to the first embodiment is referred to generally as 10 and the centrifugal pump assembly according to the second embodiment is referred to generally as 100. Like reference numbers will be used to indicate like components of the two embodiments.

It is to be understood that the centrifugal pump assembly 10 is a modification to existing overhung, horizontal, single-stage process pumps commonly available from a variety of pump manufacturers such as BW/IP International, Inc., Long Beach, Calif., Goulds Pumps, Inc., Seneca Falls, N.Y., and Sulzer-Bingham, Portland, Oreg. Similarly, the centrifugal pump assembly 100 is a modification to existing overhung, in-line, single-stage process pumps commonly available from a variety of pump manufacturers such as those named above.

The primary focus of the following detailed discussion of the centrifugal pump assembly 10, 100 will be with respect to the modification comprising the invention. The modification is primarily at the impeller end of the centrifugal pump assembly 10, 100 as will be explained below. The "unchanged" portion of the prior art process pumps will be only generally discussed as the unchanged portion is commonly known to one of ordinary skill in the art.

As shown in FIGS. 1 and 2, the centrifugal pump assembly 10, 100 includes a pump housing assembly 11 comprising a pump case 12, a pump case cover 13 and a bearing bracket 32. The pump housing assembly 11 has a primary inlet 14 and a primary discharge 16. The primary inlet 14 includes an inlet passageway 18 which communicates at its downstream end with the entrance 22 of the single-stage, single suction primary impeller 20 as shown in FIGS. 1 and 2. The primary impeller 20 has an exit 24 communicating with the primary discharge 16.

Referring to FIGS. 1 and 2, the primary impeller 20 is mounted on a cantilevered portion 28 of a shaft 26. Typically, the shaft 26 in the horizontal single stage pump with booster impeller of FIG. 1 is in a horizontal position whereas the shaft 26 in the in-line single stage pump with booster impeller of FIG. 2 is in a vertical position.

The shaft 26 includes a second end 30 (FIG. 1) opposite the cantilevered portion 28 which is adapted to be connected to a power means such as a motor (not shown) for rotating the shaft 26. Alternatively, the shaft 26 could be the motor shaft with the primary impeller 20 mounted thereon as shown in FIG. 2. Typically, the primary impeller 20 is secured on the shaft 26 with a primary impeller key (not shown) received in an elongated slot (not shown) in the shaft 26.

Referring still to FIGS. 1 and 2, a booster impeller 36 is also mounted on the cantilevered portion 28 of the shaft 26. The booster impeller 36 is secured on the shaft 26 with a booster impeller key (not shown) received in the elongated slot (not shown) in the shaft 26. Preferably, the booster impeller 36 is positioned on the shaft 26 between the primary impeller 20 and the bearings 34. As shown in FIGS. 1 and 2, the booster impeller 36 is preferably located substantially adjacent to the primary impeller 20 to minimize the overall length of the cantilevered portion 28 of the shaft 26.

The shaft 26 is supported by the bearing bracket 32. Preferably, the bearing bracket 32 includes an outboard bearing 34 and an inboard bearing 34' to rotatably support the shaft 26. A seal means 52, typically a mechanical seal, surrounds the shaft 26 between the inboard bearing 34' and the booster impeller 36. Mechanical seals are well known in the art. The type of mechanical seal 52 may vary. The mechanical seal prevents undesirable leakage of fluid to atmosphere. In an overhung-type pump only one mechanical seal is required. In a between bearing pump two mechanical seals are required.

In the preferred embodiment of the invention, conduit means 42 are provided for diverting some of the fluid flow from the primary discharge 16 to a secondary inlet or booster inlet 38. Typically, the conduit means 42 comprises tubing or piping. It is to be understood that fluid could alternatively be introduced to the secondary or booster inlet 38 without passing through the primary impeller 20, as for example, by diverting some of the fluid flow upstream of the centrifugal process pump 10, 100 or the primary impeller 20 directly to the booster inlet 38.

Figure 3:
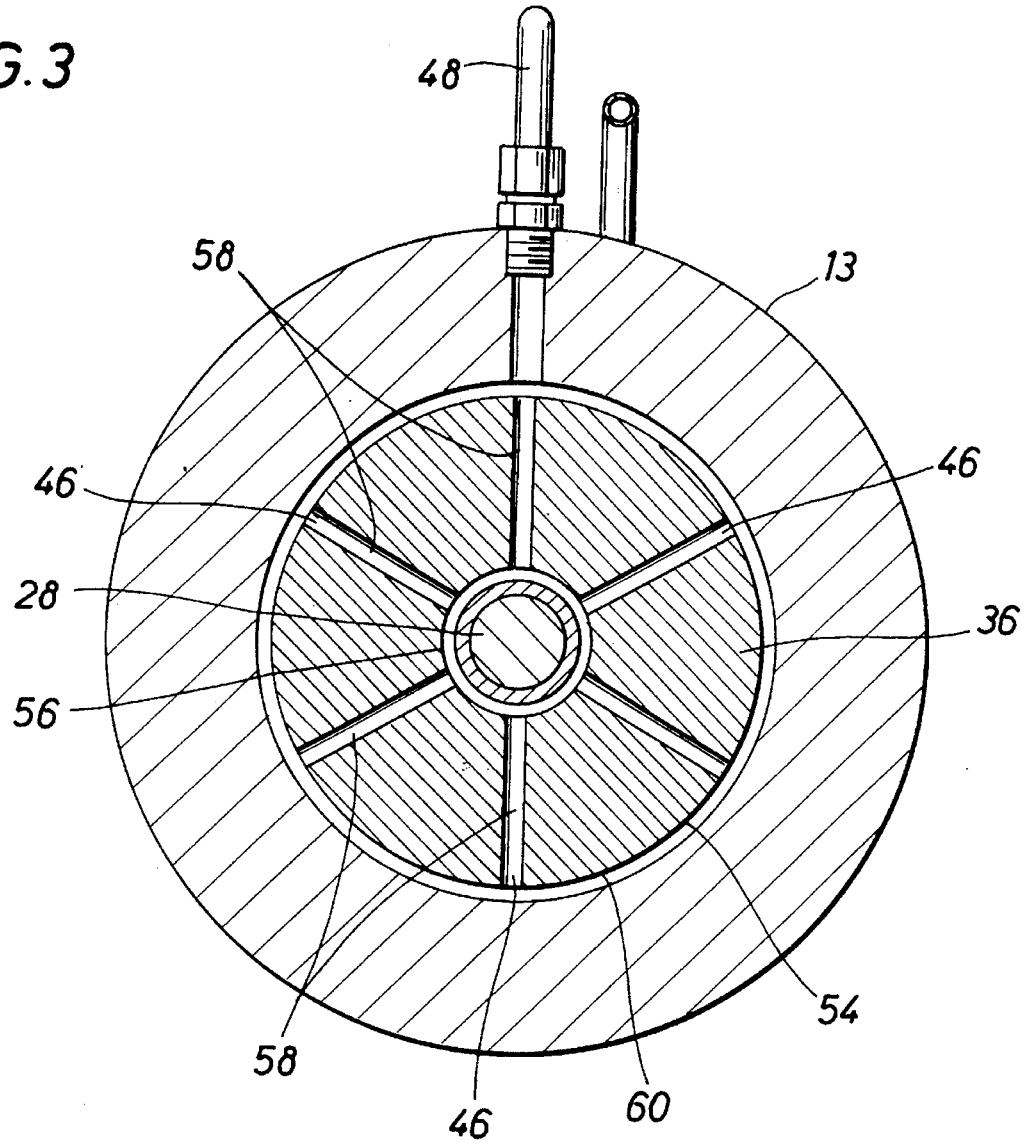
FIG. 3 is a sectional view taken along lines 3—3 of FIG. 1.

The booster inlet 38 includes a booster inlet passageway 40 which communicates at its downstream end with the booster impeller entrance 44 of the single suction booster impeller 36 as shown in FIGS. 1–3. The booster impeller 36 has an exit 46 communicating with a secondary discharge or booster discharge 48.

It is to be understood that the primary and booster impellers 20 and 36, respectively, are both mounted on the cantilevered portion 28 of the pump shaft 26. Thus, the booster impeller 36 rotates at the same speed as the primary impeller 20.

In the preferred embodiment of the invention, the booster impeller 36 is a drilled hole type impeller (see FIG. 3). It is to be understood that the booster impeller 36 is not limited to a drilled hole type impeller and that other types of impellers may be used as the booster impeller 36. As shown in FIG. 3, the drilled hole type booster impeller 36 includes a circular disc 54 having a central longitudinal bore 56 therethrough and a plurality of fluid bores 58 extending from an outer peripheral surface 60 to the central longitudinal bore 56. The fluid bores 58 are in communication with the booster impeller entrance 44 as shown in FIGS. 1–3. The fluid bores 58 as shown in FIG. 3 are radial bores. It is to be understood that the fluid bores 58 are not limited to radial bores but may have other configurations and orientations in providing communication between the outer peripheral surface 60 and the central longitudinal bore 56.

The booster impeller 36 in the preferred embodiment as shown in FIGS. 1–3 includes a peripheral shoulder 62 extending from the circular disc 54. A first spacer sleeve 63 is mounted on the shaft 26 between the booster impeller 36 and the mechanical seal 52. The booster impeller entrance 44 is defined by the annular spacing between the peripheral shoulder 62 and the first spacer sleeve 63. Opposite the peripheral shoulder 62 is an impeller hub 64 which is secured to the shaft 26.

Referring to FIGS. 1 and 2, an intermediate cover 66 is positioned between the primary impeller 20 and the booster impeller 36. The intermediate cover 66 is non-rotatably secured to the pump case assembly 12. The intermediate cover 66 includes a first interior annular recess 68 and a second interior annular recess 70. The annular recesses 68 and 70 receive stationary wear rings 69 and 71, respectively. A mating rotating wear ring 69' is installed on a neck 72 of the primary impeller 20 and a mating rotating wear ring 71' is installed on the impeller hub 64 of the booster impeller 36.

As shown in FIGS. 1 and 2, the pair of wear rings 69 and 69' rotatably mate with each other and the pair of wear rings 71 and 71' rotatably mate with each other. Each pair of wear rings permit controlled leakage of fluid therebetween. Wear rings are well known in the art.

Referring to FIGS. 1 and 2, a second spacer sleeve 74 is mounted on the shaft 26 between the primary impeller 20 and the booster impeller 36.

Balance holes 76 extend through a rear shroud 78 of the primary impeller to the entrance 22. The balance hole or holes 76 permit fluid communication between the entrance or suction of the primary impeller 20 and the fluid passing between the pairs of wear rings 69, 69' and 71, 71'. Thus, if the booster impeller 36 is "dead-headed" (i.e., no flow through the booster impeller) as for example by closing off the booster discharge 48, the controlled leakage through the pair of mating wear rings 71, 71' and the balance holes 76 to the suction of the primary impeller 20 prevents "dead-heading" damage caused from overheating. It is to be understood that the booster impeller discharge 48 may be run dead-headed providing the primary impeller is protected in accordance with its minimum flow criteria.

Preferably, the booster impeller entrance 44 faces opposite the primary impeller 20 as shown in FIGS. 1 and 2. This shortens the length of the cantilevered portion 28 of the shaft 26 and also reduces the sealing pressure requirement of the mechanical seal 52 to that of the primary discharge pressure as opposed to the higher booster discharge pressure.

Referring to FIGS. 1 and 2, the diameter of the booster impeller 36 is approximately the same diameter as the primary impeller 20. The diameter of an impeller has a direct effect on the head produced. Typically, the booster impeller 36 will have a diameter approximately the same as the primary impeller 20 to optimize the design. It is to be understood, however, that this does not have to be the case and that the booster impeller 36 may have a larger or smaller diameter than the primary impeller 20.

In a typical/conventional 4 inch, two-stage overhung pump, adding the second stage results in approximately 7.25 inches being added to the shaft cantilever. A 4 inch, single-stage overhung pump with booster impeller 10, 100 according to the present invention adds approximately 1.50 inches to the shaft cantilever 28. Minimizing the length of the shaft cantilever 28 is a significant feature in overhung pump design.

It is to be understood that the primary discharge 16 is a high flow, low head discharge and the booster discharge 48 is a lower flow, higher head discharge.

The centrifugal pump assembly with booster impeller 10, 100 is effectively two pumps in one pump case/cover assembly 12, 13 with the pump assembly 10, 100 having a common suction 18 and two separate discharges 16 and 48. It is not classified as a two-stage pump because the primary and booster impellers 20 and 36, respectively, do not pump the same flow (i.e., all flow from primary impeller 20 does not flow through booster impeller 36). The booster impeller 36 is incorporated into the same pump case/cover assembly 12, 13 as the primary impeller 20 and increases the shaft cantilever 28 by only approximately 20% as compared with approximately 100% for the second stage impeller of a conventional two-stage overhung pump.

The following two examples illustrate the advantages of the present invention in the case where a pump is to be selected to discharge to two or more locations. The rating points for two destinations are as follows:

| | Rating Points | |
|---|---|---|
| | Example 1 | Example 2 |
| Destination "A" | 10 gpm @ 530 ft | 10 gpm @ 725 ft |
| Destination "B" | 725 gpm @ 240 ft | 725 gpm @ 430 ft |

EXAMPLE 1

Figure 4:
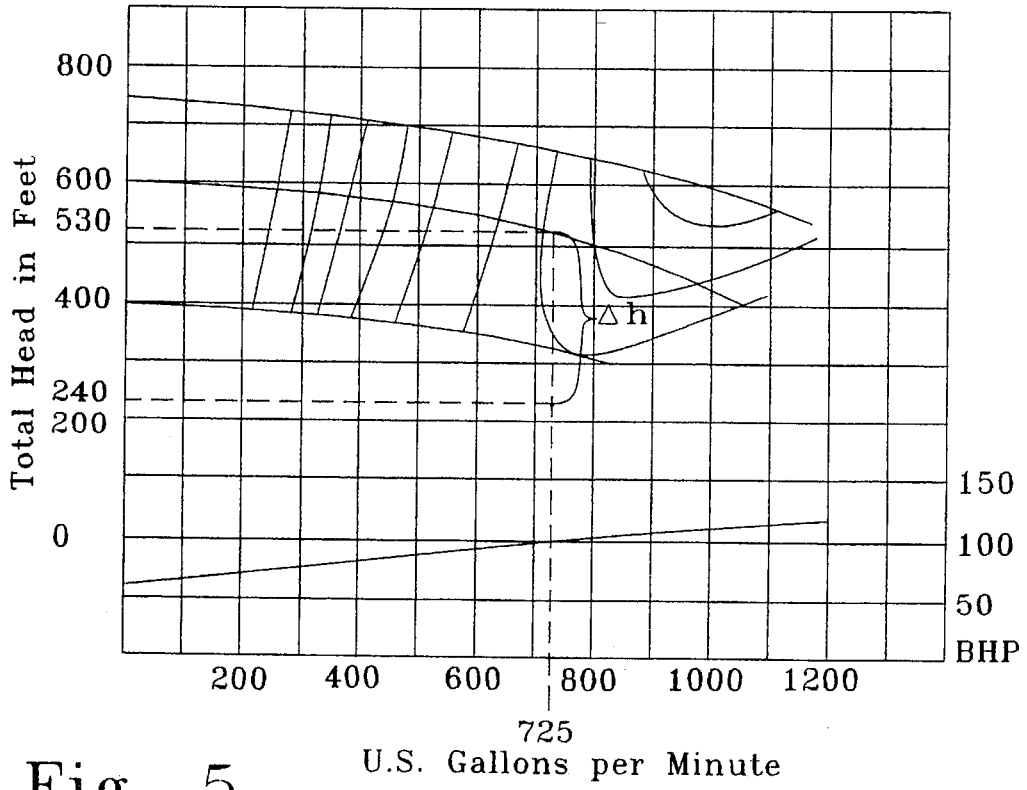
FIG. 4 is a diagram showing typical pump performance curves for a conventional 4 inch, single stage, overhung pump for three sizes of impellers.

CONVENTIONAL: A typical pump selection, using a conventional 4-inch single-stage, overhung-type pump with a 12.0-inch diameter impeller enveloping both rating points is illustrated in FIG. 4. Points "A1" and "B1" indicate the rating points for destinations "A" and "B", respectively, in the first example. Note that the excess head ($\Delta$ h) at point "B1" requires the use of a 125 hp motor.

Figure 5:
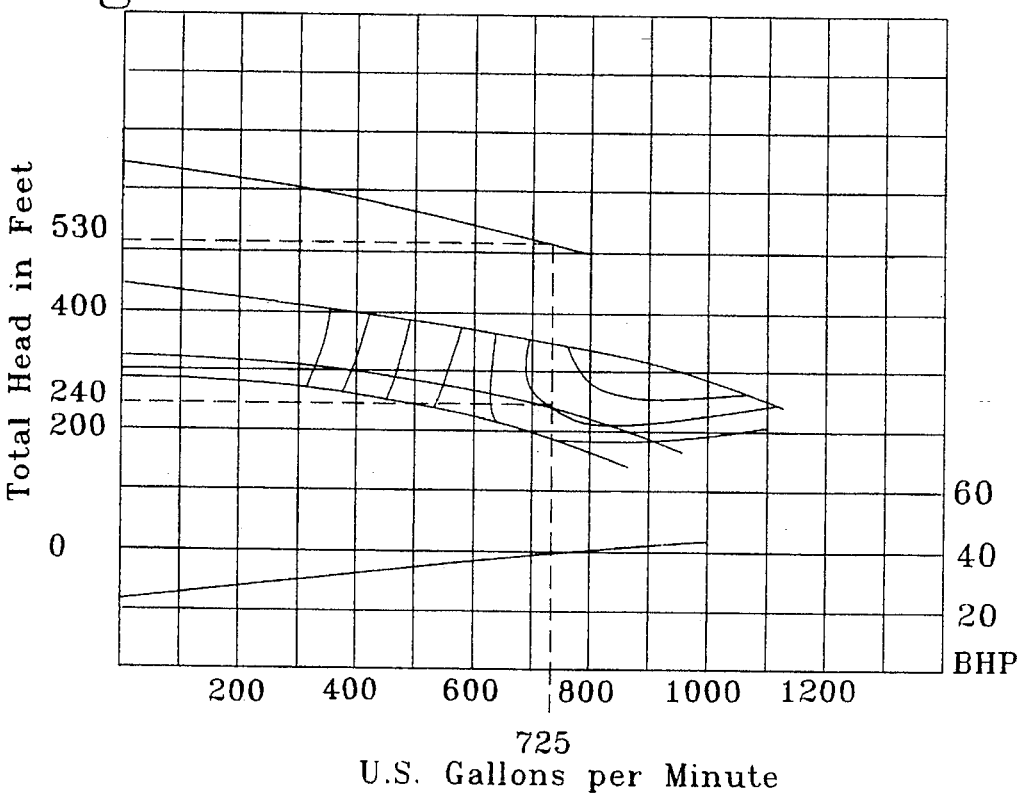
FIG. 5 is a diagram showing typical pump performance curves for a conventional 4 inch, single stage, overhung pump for three sizes of impellers and including a performance curve for a booster impeller.

ALTERNATE: The performance of a 4 inch pump with a 9.0 inch diameter primary impeller and a low-flow booster impeller is illustrated in FIG. 5. The diameter of the booster impeller is 9.0 inches. This pump requires a 60 hp motor. The power savings for this example is as follows:

CONVENTIONAL WITH 125 HORSEPOWER MOTOR: 4×6×13 pump with 12.0 inch diameter impeller.

ALTERNATE WITH 60 HORSEPOWER MOTOR: 4×6×10 pump with 9.0 inch diameter impeller and booster impeller.

| BRAKE HORSEPOWER REQUIREMENT @ RATED FLOW (725 GPM) | |
|---|---|
| Conventional | 102 BHP (0.72 specific gravity (SG)) |
| Alternate | 49 BHP (0.72 SG) |
| BHP Differential | 53 BHP (0.72 SG) |
| | 40 KW |
| Operating Hours | 8,760 Hrs (one year) |
| Power Savings | 350,400 KWH per year |

EXAMPLE 2

Figure 6:
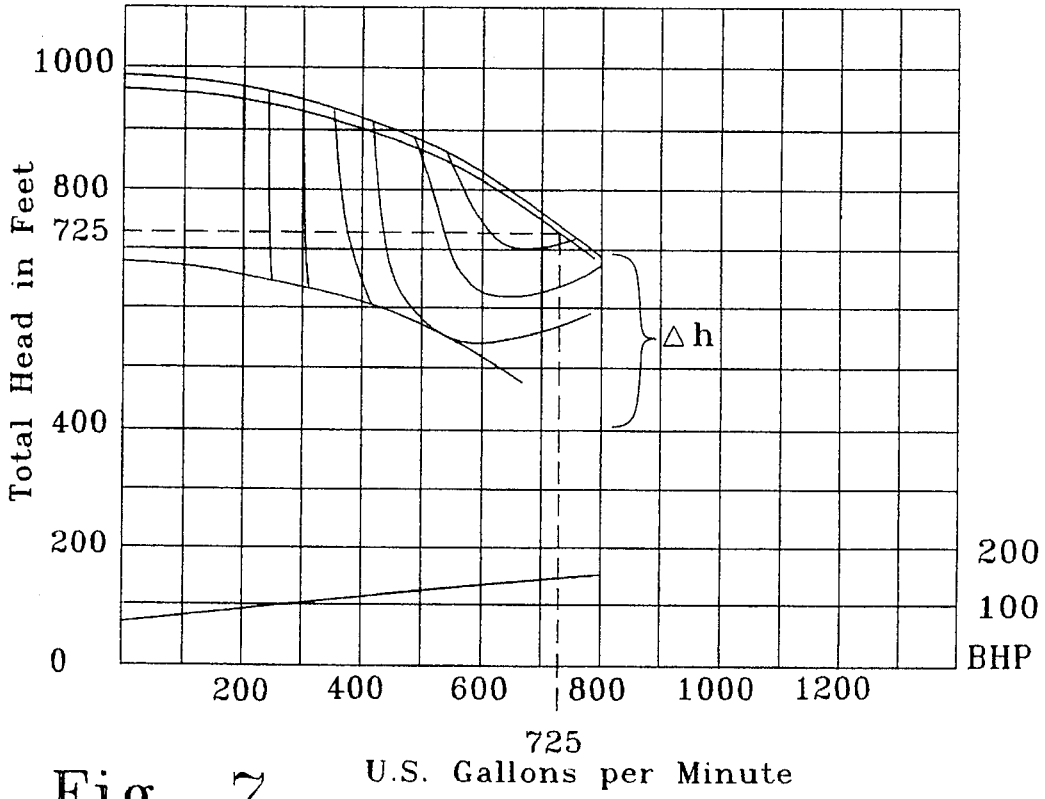
FIG. 6 is a diagram showing typical pump performance curves for a conventional 3 inch, single stage, overhung pump for three sizes of impellers.

CONVENTIONAL: A typical pump selection, using a conventional 3-inch single-stage, overhung-type pump with a 14.85-inch diameter impeller enveloping both rating points is illustrated in FIG. 6. The excess head at point "B2" requires the use of a 200 hp motor.

Figure 7:
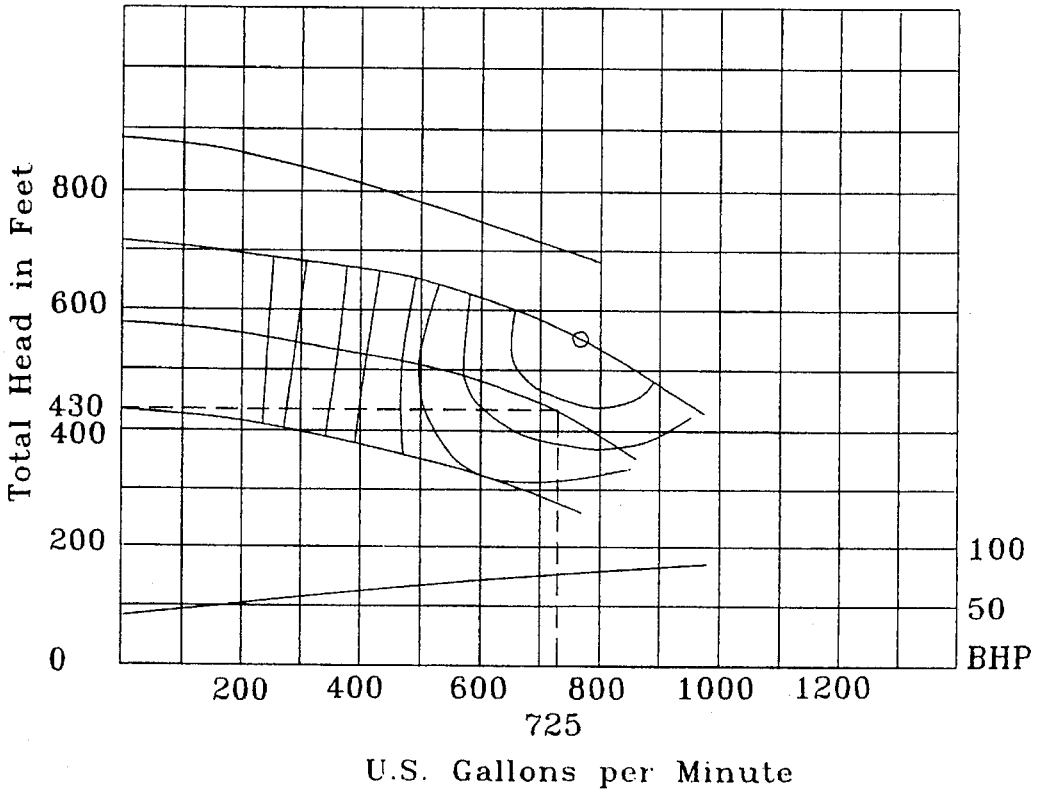
FIG. 7 is a diagram showing typical pump performance curves for a conventional 3 inch, single stage, overhung pump for three sizes of impellers and including a performance curve for a booster impeller.

ALTERNATE: The performance of a 3-inch pump with a 11.66-inch diameter impeller and a low-flow booster impeller is illustrated by FIG. 7. This pump uses a 100 hp motor. The power savings for this example is as follows:

CONVENTIONAL WITH 200 HORSEPOWER MOTOR: 3×6×15 pump with 14.85 inch diameter impeller.

ALTERNATE WITH 100 HORSEPOWER MOTOR: 3×4×13 pump with 11.66 inch diameter impeller and booster impeller.

| BRAKE HORSEPOWER REQUIREMENT @ RATED FLOW (725 GPM) | |
|---|---|
| Conventional | 165 BHP (0.72 SG) |
| Alternate | 88 BHP (0.72 SG) |
| BHP Differential | 77 BHP (0.72 SG) |
| | 58 KW |
| Operating Hours | 8,760 Hrs (one year) |
| Power Savings | 508,080 KWH per year |

Figure 8:
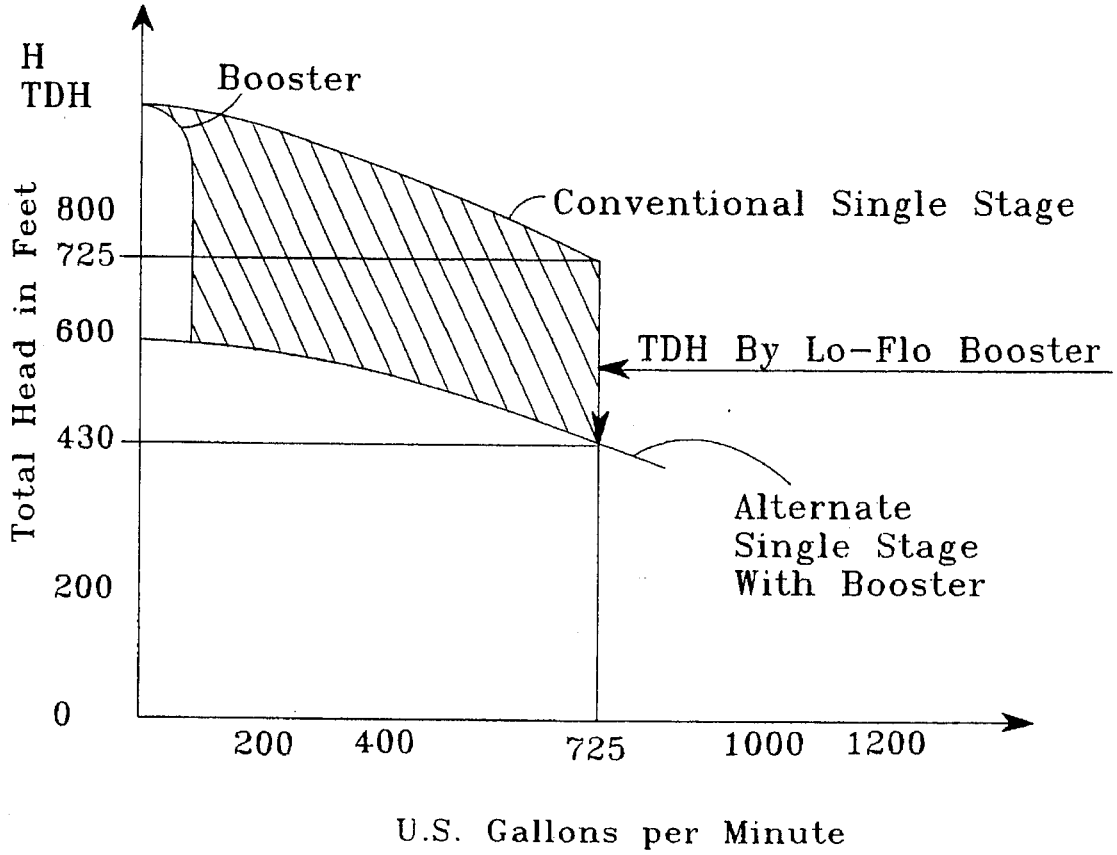
FIG. 8 is a diagram comparing pump performance curves and illustrating the advantages of the present invention over conventional process pumps.

FIG. 8 illustrates the significant advantages of the present invention using example 2 above. The cross-hatched area shows the head-capacity produced but not required by the process by the conventional 3-inch single-stage, overhung-type pump with a 14.85-inch diameter impeller and a 200 hp motor. The use of the 3-inch pump with a 11.66-inch diameter impeller and a low-flow booster impeller according to the present invention with a 100 hp motor saves the brake horsepower required to produce the unneeded capability (cross-hatched area) and the downstream throttling required to satisfy the lower head requirement of destination "B."

As some selection criteria do not allow use of impellers larger than 13-inch diameter in overhung-type, 3600 rpm pumps, it is significant that use of a booster impeller not only reduces operating costs, but saves capital cost by allowing use of the overhung-type, compared with the more expensive between-bearing type pump which might be required for example 2.

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. An overhung, centrifugal process pump for separating a liquid into a primary flow stream and into a secondary flow stream having a pressure greater than the primary flow stream pressure, comprising:

a housing having a primary inlet, a primary outlet, a secondary inlet for receiving liquid from said primary flow stream, and a secondary outlet;

a rotatable process pump shaft having a cantilevered portion within said housing;

a seal for preventing liquid flow between said shaft and said housing;

a single primary impeller, engaged with the cantilevered portion of said shaft, for receiving liquid from said primary inlet and for pumping liquid through said primary outlet to create the primary flow stream;

a booster impeller, engaged with the cantilevered portion of said shaft proximate to said primary impeller, for receiving liquid from said secondary inlet and for pumping the liquid through said secondary outlet to create the secondary flow stream, and a balance hole for communicating liquid from said booster impeller to said primary impeller.

2. An overhung, centrifugal process pump for separating a liquid into a primary flow stream and into a secondary flow stream having a pressure greater than the primary flow stream pressure, comprising:

a housing having a primary inlet, a primary outlet, a booster inlet for receiving liquid from said primary flow stream, and a booster outlet;

a rotatable process pump shaft having a cantilevered portion within said housing;

a seal for preventing liquid flow between said shaft and said housing;

a single primary impeller engaged with the cantilevered portion of said shaft for receiving liquid from said primary inlet and for pumping liquid through said primary outlet to create the primary flow stream, wherein said primary impeller is positioned within a primary flow passageway in said housing between said primary inlet and said primary outlet;

a booster impeller, engaged with the cantilevered portion of said shaft proximate to said primary impeller, for receiving liquid from said booster inlet and for pumping liquid through said booster outlet to create the secondary flow stream, wherein said booster impeller is positioned within a secondary flow passageway in said housing between said booster inlet and said booster outlet; and a balance hole for communicating liquid from said booster impeller to said primary impeller, including when said booster impeller is dead-headed.

* * * * *